United States Patent [19]

Heintz

[11] 4,087,205

[45] May 2, 1978

[54] FREE-PISTON ENGINE-PUMP UNIT

[76] Inventor: Richard P. Heintz, 1841 Oakland Dr., Kalamazoo, Mich. 49008

[21] Appl. No.: 601,226

[22] Filed: Aug. 1, 1975

[51] Int. Cl.[2] ..... F04B 31/00; F04B 35/00

[52] U.S. Cl. ..... 417/11; 417/324; 417/396; 60/395

[58] Field of Search ..... 417/11, 324, 396; 123/46; 60/395, 396

[56] References Cited

U.S. PATENT DOCUMENTS

| | | | |
|---|---|---|---|
| 1,083,568 | 1/1914 | Ungar | 417/324 |
| 2,077,802 | 4/1937 | Martin | 417/11 |
| 2,382,598 | 8/1945 | Andresen | 417/324 |
| 2,425,850 | 8/1957 | Welsh | 417/11 |
| 2,466,132 | 4/1949 | Tetreault | 417/396 |
| 2,831,626 | 4/1958 | Perrott | 417/349 |
| 2,914,909 | 12/1959 | Kubik | 417/396 |
| 3,072,315 | 1/1963 | Wachsmith | 417/324 |
| 3,089,305 | 5/1963 | Hobbs | 417/396 |
| 3,149,773 | 9/1964 | Cudahy | 417/324 |
| 3,432,088 | 3/1969 | Steiger | 417/11 |

FOREIGN PATENT DOCUMENTS

| | | | |
|---|---|---|---|
| 1,220,634 | 5/1960 | France | 417/396 |

*Primary Examiner*—William L. Freeh

*Attorney, Agent, or Firm*—Blanchard, Flynn, Thiel, Boutell & Tanis

[57] ABSTRACT

A hybrid propulsion system, particularly for a vehicle, having a free piston type engine-pump unit connected to a working fluid circuit for controlling pressurization of a working fluid, which fluid in turn drives a hydraulic motor interconnected to the vehicle wheels. The motor-pump unit includes a free piston assembly having a pair of fixedly connected power pistons, each of which has a pump piston fixed thereto. The fluid system includes high and low pressure accumulators in communication with pumping chambers associated with the pump pistons. The power pistons are used for driving the pump pistons to pressurize the working fluid when self-sustained operation of the engine-pump unit is desired. However, the flow of working fluid to the pumping chambers can be reversed during startup of the engine so that the high pressure fluid is used for driving the free piston assembly until same is reciprocated at a rate rapidly enough to permit self-sustained reciprocation thereof.

19 Claims, 11 Drawing Figures

FIG. 1
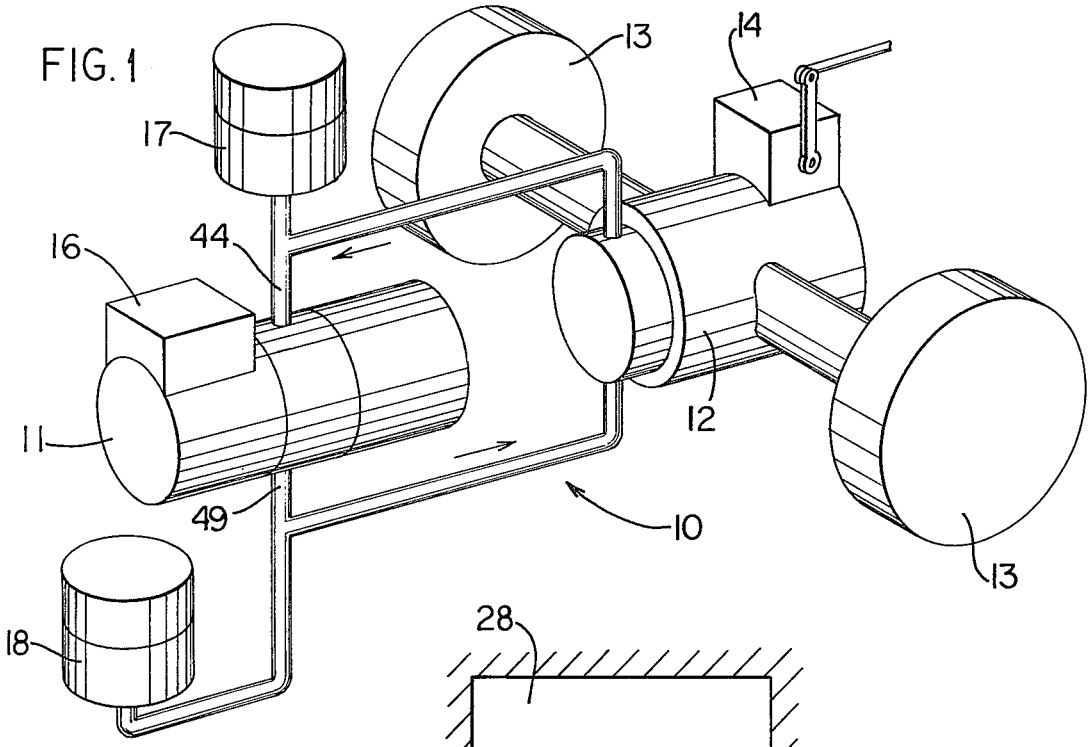
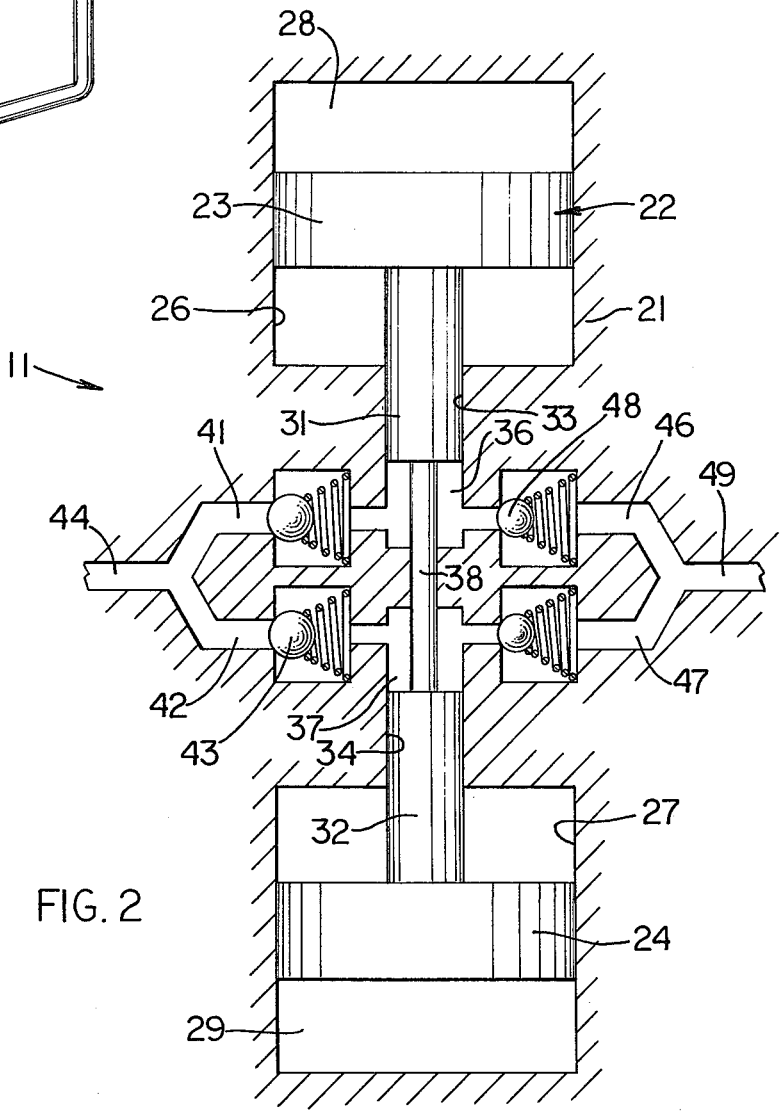
FIG. 2

FREE-PISTON ENGINE-PUMP UNIT

DETAILED DESCRIPTION

This invention relates to an improved power generation system in general, and in particular to an improved vehicular propulsion system. More specifically, the invention relates to a propulsion system incorporating a free piston engine-pump unit.

BACKGROUND OF THE INVENTION

As will be appreciated by those familiar with vehicular propulsion systems, such systems are desirably highly efficient and emit to the atmosphere low levels of pollutants. However, known systems which attempt to conform to these requirements are characterized by extremely high cost of manufacture, excessive weight, costly maintenance and/or inconvenience to the user.

Accordingly, the primary object of the present invention is to provide an improved propulsion system, particularly for a vehicle, which is low in cost, efficient in operation, and emits only a minimum of pollutants.

A further object is to provide a propulsion system using only a single main reciprocating part which acts both as a piston for an internal combustion engine and as a piston for a hydraulic pump, which combination is hereinafter referred to as an engine-pump unit.

A still further object of the invention is to provide an engine of the so called free-piston type, which engine includes means for supplying the necessary fuel and air to the engine so as to ensure efficient yet self-sustained operation of the engine.

Another object of the invention is to provide control means which permit starting and restarting of the engine-pump unit in a simple and efficient manner until the reciprocating movement of the engine is self-sustained.

It is also an object of the invention to provide a propulsion system, as aforesaid, incorporating an improved means of pumping hydraulic fluid in association with an internal combustion engine, whereby the hydraulic fluid functions as a medium for driving a vehicle.

A further object of the invention is to provide an improved fuel injection system for use with a free piston engine-pump unit, and in particular a simple fuel-injection system which uses the motion of the engine or pump piston for providing the impetus for both injecting the fuel and controlling the amount of fuel so injected, both as a function as the time interval between engine cycles and the pressure of the hydraulic fluid being pumped.

Still a further object of the invention is to provide a control system, specifically a cycling change valve assembly, for association with the engine-pump unit to permit efficient and simple startup of the unit by reversing the flow of hydraulic fluid to the pump pistons so as to drive the free piston assembly up to speed until self-sustained operation by virtue of fuel combustion can be achieved.

It is also an object of the invention to provide an improved scavenge valve system associated with the engine-pump unit, which scavenge valve system uses the cyclically varying hydraulic pressures for actuating the scavenge valves, and which system also provides for proper actuation of the scavenge valves during startup of the engine-pump unit.

Other objects and purposes of the present invention will be apparent to persons acquainted with systems of this general type upon reading the following specification and inspecting the accompanying drawings.

BRIEF DESCRIPTION OF THE DRAWINGS

FIG. 1 is a perspective view of a propulsion system according to the present invention.

FIG. 2 is an enlarged cross-sectional view which diagrammatically illustrates the engine-pump unit.

Figure 4:
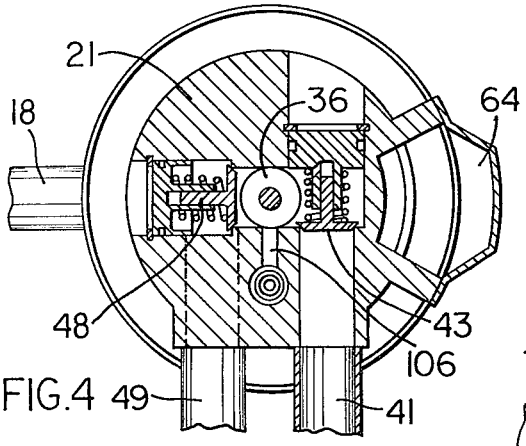
FIGS. 4 and 4A are sectional views respectively taken along lines IV—IV and IVA—IVA in FIG. 3.
Figure 4A:
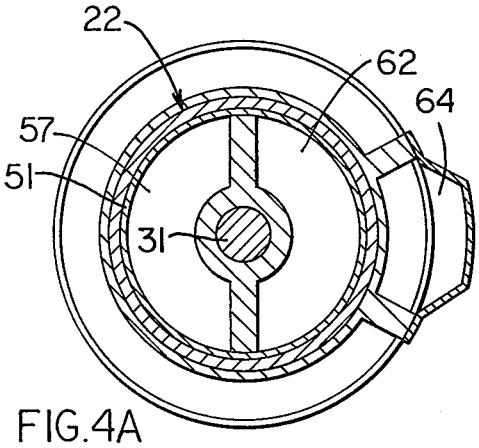

Certain terminology will be used in the following description for convenience in reference only and will not be limiting. For example, the words "upwardly", "downwardly", "rightwardly", and "leftwardly" will refer to directions in the drawings to which reference is made. The words "inwardly" and "outwardly" will refer to directions toward and away from, respectively, the geometric center of the system and designated parts thereof. Said terminology will include the words above specifically mentioned, derivatives thereof and words of similar import.

SUMMARY OF THE INVENTION

The objects and purposes of the present invention, including those mentioned above, have been met by providing a hybrid propulsion system using an internal combustion engine for driving a pump, which pump pressurizes a working fluid, specifically an incompressible fluid such as hydraulic fluid. The pressurized fluid is used for driving a hydraulic motor interconnected to the vehicle wheels. The invention particularly provides an improved power unit in the form of a free-piston engine-pump unit which incorporates a piston means having opposed power pistons which are fixedly interconnected. The opposed power pistons in turn have pumping pistons fixedly connected therewith. High and low pressure accumulators for the working fluid are connected via a conduit and valving system to the pumping chambers so that fluid is supplied from the low pressure accumulator to the pumping chambers, and is pressurized by the engine-pump unit and discharged to the high pressure side of the system, which includes the high pressure accumulator. A cycling control valve assembly is associated with the engine-pump unit and is activated during startup of the engine-pump unit, whereby the flow of pressure fluid to the pump assembly is reversed so that the high pressure fluid is supplied to the one pumping chamber to cause driving of the piston means until self-sustained reciprocating movement of the piston means can be achieved. The engine-pump unit also has a fuel injection system associated with the combustion chambers which are located adjacent the opposite ends of the piston means. The fuel injection is controlled by the pressurized working fluid or by the movement of the power piston.

DETAILED DESCRIPTION

FIG. 1 diagrammatically illustrates therein a hybrid propulsion system 10 according to the present invention, which system is designed particularly for use on a vehicle, such as an automobile. The system 10 includes a power unit 11, specifically an engine-pump unit, connected to a variable displacement hydraulic motor 12 of conventional design. The motor 12 is controlled by the driver's throttle and is drivingly connected to the wheels 13. Motor 12 has a suitable control unit 14 associated therewith, which is connected to the vehicle throttle, and a further control unit 16 is associated with the power unit 11. Conventional low and high pressure accumulators 17 and 18, respectively, are associated with the system for storing therein the working fluid, namely hydraulic fluid, which is circulated between the power unit 11 and the motor 12.

The present invention is particularly concerned with the structure and operation of the power unit 11, including the controls therefor, and this structure will be described in detail hereinafter.

Engine-Pump Unit

The engine-pump unit 11, as diagrammatically illustrated in FIG. 2, includes a housing 21 slidably supporting therein a reciprocating piston unit 22. Piston unit 22 includes a pair of opposed power pistons 23 and 24 slidably disposed within bores 26 and 27, respectively. Combustion chambers 28 and 29 are formed within the bores between the housing 21 and the opposed end wall of the pistons 23 and 24, respectively. Power pistons 23 and 24 respectively have pump pistons 31 and 32 fixedly connected thereto, which pump pistons are of smaller diameter and project inwardly from the power pistons in opposed relationship to one another, whereby all of the pistons are coaxially aligned. The pump pistons 31 and 32 are slidably supported within bores 33 and 34, respectively, so that pumping chambers 36 and 37 are formed adjacent the inner ends of the respective pump pistons 31 and 32. The pump pistons 31 and 32 are additionally fixedly interconnected by an intermediate rod 38 whereby both power pistons 23 and 24 and both pump pistons 31 and 32 are fixedly interconnected so as to reciprocate as a unit.

The pumping chambers 36 and 37 respectively communicate with passages 41 and 42 which have one-way check valves 43 associated therewith, and a further passage 44 interconnects the passages 41 and 42 to the low pressure accumulator 17. Further, passages 46 and 47 also respectively communicate with the pumping chambers 36 and 37 for permitting the discharge of fluid from the pumping chambers. Conventional one-way check valves 48 are associated with passages 46 and 47, which passages in turn communicate with the high pressure accumulator 18 by means of an intermediate passage 49.

Figure 3:
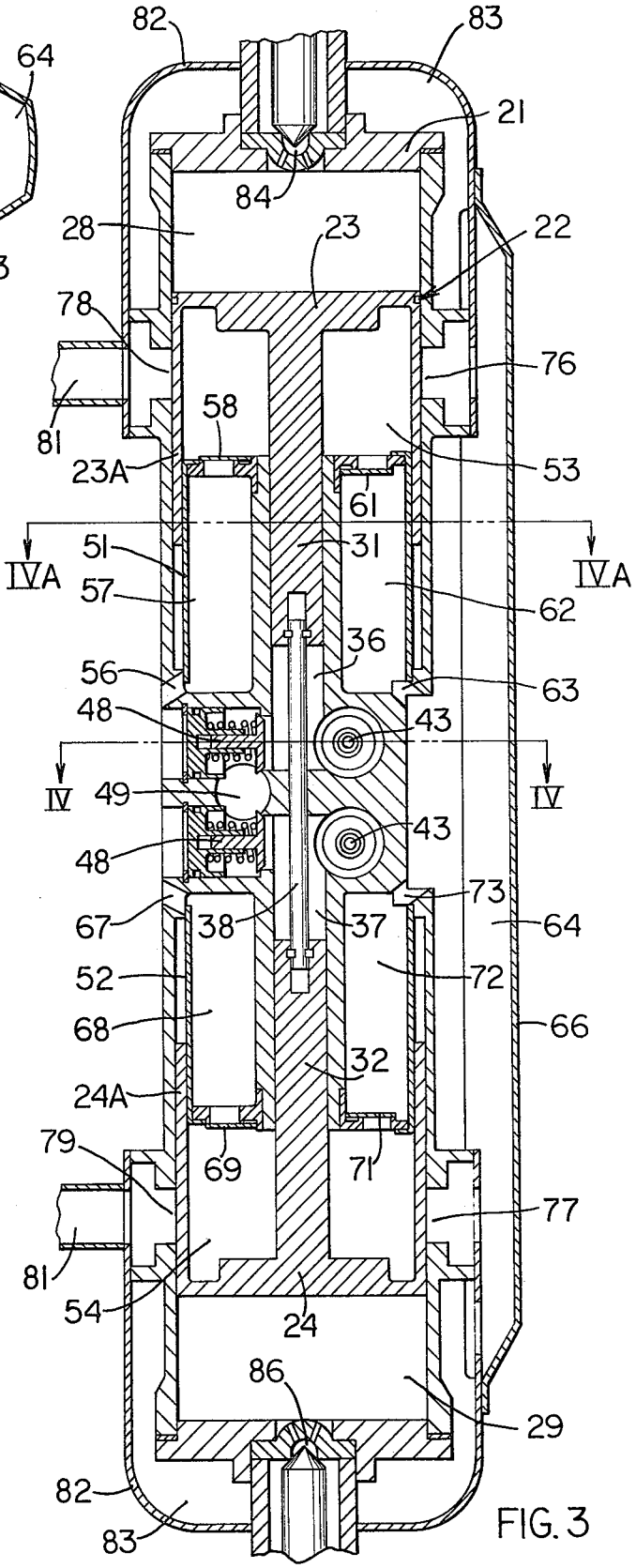
FIG. 3 is an enlarged sectional view illustrating the engine-pump unit in greater detail.

The power pistons 23 and 24 are, in a preferred embodiment as illustrated in FIGS. 3 and 4, formed of a cup-shaped configuration so as to have depending skirt portions 23A and 24A disposed for slidable engagement with the walls of the bores 26 and 27, respectively. The housing 21 further includes cylindrical guide members 51 and 52 which are fixed relatively to the housing and disposed within the bores so that the skirt portions 23A and 24A are slidably disposed on and surround the guide members 51 and 52, respectively. Intermediate chambers 53 and 54 are thus formed within the respective power pistons 23 and 24 for controlling the flow of air into the combustion chambers.

Air is supplied through an inlet port 56 into a passage 57 formed in the guide member 51, whereupon the air flows through a one-way valve 58 into the intermediate chamber 53. Air from chamber 53 flows through a one-way valve 61 into passage 62, and thence through a port 63 into a plenum chamber 64 which is formed between the housing 21 and a shroud 66.

In a similar manner, air is supplied through a port 67 into passage 68 and thence through one-way valve 69 into the other intermediate chamber 54, from which the air flows through one-way valve 71 into passage 72 and thence through port 73 for supply to the plenum chamber 64.

Air from the plenum chamber 64 flows through the inlet ports 76 and 77 so as to be supplied to the combustion chambers 28 and 29, respectively. Exhaust ports 78 and 79 are respectively associated with the combustion chambers 28 and 29 for permitting the discharge of the combustion products into the exhaust pipes 81. The above-mentioned inlet and exhaust ports are formed directly in the sidewall surrounding the combustion chambers so that the opening and closing of the exhaust ports is thus controlled by the reciprocating power pistons.

If desired, shrouds 82 can also be positioned in surrounding relationship to and spaced from the walls defining the combustion chambers, which shrouds 82 define therein chambers 83 communicating with the plenum chamber 64 so that air can be supplied to the chambers 83 to assist in cooling the engine.

The chamber 64 can, if desired, be divided into upper and lower portions, with the upper portion supplying air to the lower combustion chamber, and the lower portion supplying air to the upper combustion chamber.

A conventional fuel injector 84 and 86 is associated with the combustion chambers 28 and 29, respectively, for injection of fuel into the combustion chambers.

Steady State Operation of Engine-Pump Unit

The engine structure associated with the unit 11 utilizes a two-cycle mode of operation, so that a power generating explosion occurs in each combustion chamber during each reciprocating stroke of the piston unit 22. The combustion of a fuel-air mixture within the combustion chamber is induced by compression, as is convention with diesel engines, in contrast to being spark-induced as with a conventional four-cycle engine.

During the upward stroke of the piston unit 22, the upper air chamber 53 expands in volume so that air is drawn through the port 56 and supplied into the chamber 53, whereas the lower chamber 54 decreases in volume so that the air previously drawn therein is compressed and forced through the one-way valve 71 into the plenum chamber 64. During this upward stroke of the piston unit, the ports 76 and 78 are initially uncovered so that fresh air flows from chamber 64 through inlet port 76 into the combustion chamber 28 so as to scavenge same, with the exhaust gases flowing out the port 78. Continued upward movement of the piston unit 22 closes off the ports 76 and 78 so that the air in combustion chamber 28 is compressed. Further upward movement of the piston unit uncovers the ports 77 and 79 associated with the lower power piston 24 so that fresh air is supplied into the combustion chamber 29 and the exhaust gases flow therefrom through the exhaust port 79. As the piston unit 22 approaches its uppermost position, resulting in maximum compression of the air in the combustion chamber 28, fuel is injected into the chamber 28 by the fuel-injection device 84. This causes a compression-ignition to take place, so that the fuel in chamber 28 burns, causing expansion of the gases therein and accordingly causing a downward powered driving of the piston unit 22.

During the downward stroke of the piston unit as caused by combustion in the chamber 28, the above sequence of events again takes place except that the operation relative to the power pistons 23 and 24 is reversed until a compression-ignition takes place within the chamber 29 when the piston unit 22 reaches its lowermost position, whereby the combustion in chamber 29 causes an upward driving of the piston unit 22.

When the piston unit is being moved upwardly, as due to combustion in chamber 29, the hydraulic fluid in pumping chamber 37 is compressed by the piston 32 and supplied through the one-way valve 48 into the high pressure accumulator 18. At the same time, fluid flows from the low pressure accumulator 17 through the check valve 43 into the other pumping chamber 36. The reverse action takes place during the downward stroke of the piston unit 22, as caused by combustion within the chamber 28, since piston 31 then causes the hydraulic fluid in chamber 36 to be pressurized and forced outwardly through the check valve 48 so as to be supplied to the high pressure accumulator 18, and simultaneously therewith fluid flows from the low pressure accumulator 17 through the check valve 43 into the pumping chamber 37.

Cycling Valve Assembly

When the engine-pump unit 11 is to be started or restarted, it is cycled up to its operating speed whereupon the normal power generating action takes over so as to maintain the cycling action of the engine-pump unit. However, in order to cycle the engine-pump unit up to its operating speed, the normal pumping action of the unit is reversed so that the hydraulic fluid is used to initiate the reciprocating movement of the piston unit 22. To provide for proper control over the hydraulic fluid to cause driving of the piston unit 22 during startup, there is provided a cycling valve assembly 101 (FIG. 5) for controlling the flow of hydraulic fluid.

The cycling valve assembly 101 is disposed within a bore 102 formed in the housing, which bore extends substantially parallel to the direction of reciprocating movement of the piston unit 22. An elongated shuttle valve 103 is slidably supported within the bore 102, and an elongated rodlike toggle valve 104 is concentrically and slidably supported within the shuttle valve 103. The housing has a pair of ports 106 and 107 formed therein and disposed in communication with the bore 102, which ports respectively communicate with the pumping chambers 36 and 37. Further, ports 108 and 109 communicate with the bore 102, which ports are interconnected to the low pressure accumulator 17. A still further port 111 is disposed between the ports 108 and 109 and is connected to the high pressure accumulator 18. The shuttle valve 103 has a plurality of annular lands 112, 113, 114 and 116 formed thereon and disposed in sliding sealing engagement with the wall of the bore 102 for controlling the communication between the above-mentioned ports.

Shuttle valve 103 has a port 117 formed through the wall thereof, which port provides communication between the port 111 and an elongated annular passage 118 which is formed between the shuttle valve 103 and the toggle valve 104. The annular passage 118 communicates at its lower end with a lower shuttle chamber 119 which is formed between the valves 103 and 104. The upper end of the annular passage 118 similarly communicates with an upper shuttle chamber 121 which is also formed between the valves 103 and 104.

The upper shuttle chamber 121 is closed by a waster sleeve 122 which is slidably supported on and between the valves 103 and 104. The waster sleeve 122 abuts against the lower end of a cup-shaped centering piston 123, which piston in turn is slidably disposed within a cup-shaped end cap 124 fixedly associated relative to the housing 21.

An elongated toggle pin 126 is slidably mounted on the upper centering piston 123, which pin projects slidably through the end cap 124 and has the upper end positioned so as to be contacted by the upper power piston 23 when same is adjacent its lowermost position. A conventional compression spring 127 coacts between the opposed ends of the toggle valve 104 and toggle pin 126.

There is additionally defined a shuttle end chamber 128 disposed adjacent the upper end of the shuttle valve 103, which chamber 128 is defined in surrounding relationship to the waster sleeve 122. This upper shuttle end chamber 128 is in continuous communication with the port 108.

The lower end of the shuttle valve 103 is disposed in slidable surrounding relationship to a sleeve portion 131 associated with a lower centering piston 132. This piston in turn is slidably supported within a lower cup-shaped end cap 133 which is fixedly associated relative to the housing 21. The lower centering piston 132 also has an elongated toggle pin 136 slidably mounted thereon, which toggle pin slidably extends through the end cap 133 and is adapted to be contacted by the lower power piston 24 when same is adjacent its uppermost position. A compression spring 137 coacts between the opposed ends of the toggle pin 136 and toggle valve 104.

The toggle valve 104 has an enlarged cylindrical portion 141 formed on the lower end thereof, which portion has a passage 142 extending axially therethrough and communicating with a shuttle control chamber 143 formed adjacent the lower end of the shuttle valve 103. A first port 146 is formed through the sidewall of the cylindrical portion 141 so as to selectively provide communication between the lower shuttle chamber 119 and the passage 142. A further port 147 also extends through the wall of the cylindrical portion 141 and is adapted to provide communication between the passage 142 and a further port 148 which is formed through the sidewall of the shuttle valve 103. The port 148 in turn communicates with a lower shuttle end chamber 149 which surrounds the shuttle valve 103 and is in communication with the port 109.

The toggle valve 104 has a stop pin 151 fixed thereto and projecting outwardly therefrom, which pin is disposed within the upper shuttle chamber 121 and is provided for limiting the downward movement of valve 104 relative to valve 103. The upward movement of valve 104 relative to valve 103 is limited by the shoulder 140 which moves into engagement with the upper end wall of the chamber 143.

The upper end cap 124 has a passage 153 formed therein and communicating with an annular chamber 154 which is disposed above the upper centering piston 123. A similar passage 156 is formed in the lower end cap 133 and communicates with a chamber 157 formed behind the lower centering piston 132. The passages 153 and 156 are both connected to a conventional shiftable flow control valve 158, which valve in turn provides communication with the low and high pressure accumulators by means of intermediate conduits 161 and 162 respectively.

The lower end cap 133 also has an internal annular shoulder 164 formed thereon, which shoulder functions as a stop so as to limit the upward displacement of the lower centering piston 132.

Figure 5:
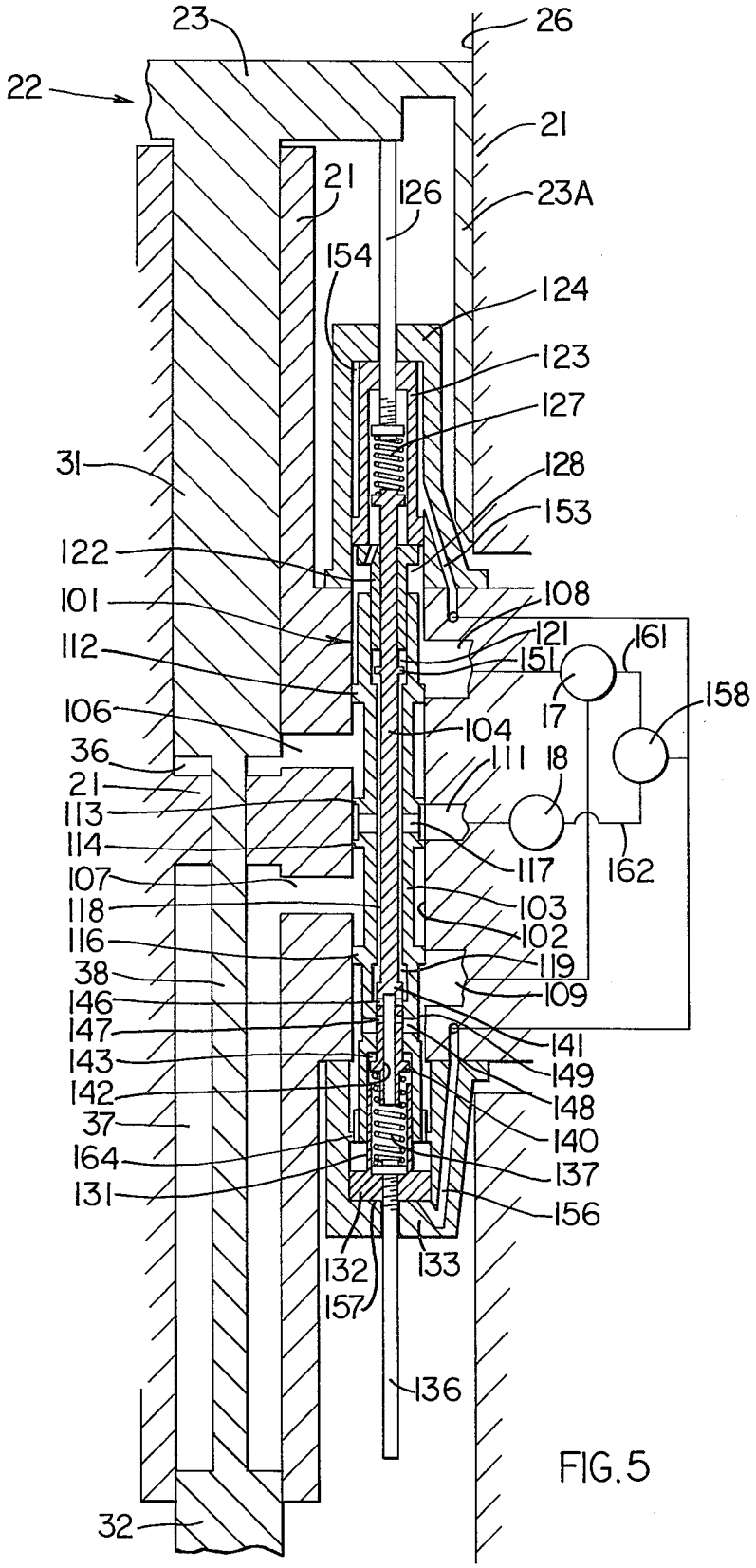
FIG. 5 is an enlarged sectional view of the cycling valve assembly as used in association with the engine-pump unit illustrated in FIG. 3.
Figure 5A:
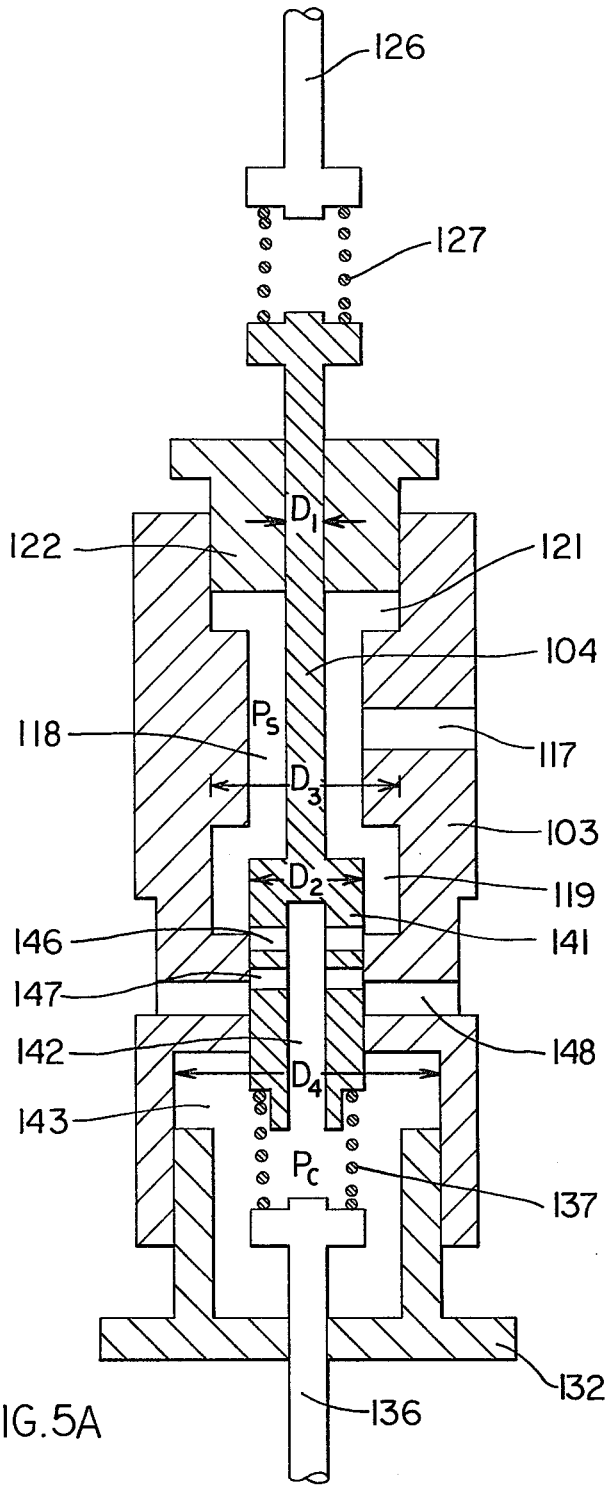
FIG. 5A is an expanded view of a portion of FIG. 5.

Referring to FIG. 5A, which is an expanded view of the essential features of shuttle valve 103 and toggle valve 104, the forces on toggle valve 104 result in a toggling action to assist in shifting the valve through its center position into either an upper or lower position. Diameter D1 of toggle valve 104 is less than diameter D2 of the enlarged cylinder portion 141. If a pressure $P_c$ exists in the shuttle control chamber 143 which is greater than $$\frac{Ps}{\left(\frac{D2}{D1}\right)^2 - 1},$$

the hydraulic force on valve 104 is upward; if less, downward. The preferred value of the ratio D2/D1 is equal to $\sqrt{2}$, so that the transition from upward to downward force occurs at $P_c = \frac{1}{2}P_s$.

The toggle valve 104 is not only subject to forces due to hydraulic pressures $P_s$ and $P_c$, but its position relative to shuttle valve 103 determines the magnitude of pressure $P_c$. This is achieved by the positions of ports 146 and 147. Assume valve 104 is in the position shown, which is the midposition of valve 104 with respect to valve 103, then port 146 is partially open and allows communication between lower shuttle chamber 119 and shuttle control member 143. Port 147 is also partially open and allows communication between lower shuttle chamber 143 and port 148, the latter being at the pressure of the low pressure accumulator. This midposition is a transient condition. Under the above conditions, flow of hydraulic fluid occurs from lower shuttle chamber 119, thru port 146 to passage 142, then thru port 147 to low pressure. The hydraulic forces on toggle valve 104 in this midposition 104 are thus balanced if the openings of ports 146 and 147 are equal. Any motion of valve 104 in either direction, however, changes the flow areas of ports 146 and 147 and causes the value of $P_c$ to change such that valve 104 is urged further in the same direction. For instance, if valve 104 is moved slightly upward, port 146 is opened further and port 147 is closed off. This causes pressure $P_c$ to rise, urging valve 104 still further upward.

The hydraulic force on shuttle valve 103 is of the same nature. The ratio of diameters D4/D3 is also preferably equal to essentially $\sqrt{2}$. Thus, shuttle valve 103 moves upward when $P_c$ is greater than $\frac{1}{2}P_s$, and downward when $P_c$ is less than $\frac{1}{2}P_s$. Thus, there is also a toggling force on the valve 103. Since D2 and D4 are preferably much larger than D3 and thus D1, the forces on valve 103 are much larger than the forces on valve 104, such as is normally required to move valve 103 against the forces imposed on it due to the flows in and out of ports 106 and 107.

Start-up of Engine-Pump Unit

When the piston unit 22 is in or adjacent its lowermost position, pressure fluid from the high pressure accumulator 18 is ported into the upper pumping chamber 36, and simultaneously the pressure fluid in the lower pressure chamber 37 is ported into the lower pressure accumulator 17. This thus causes the piston unit 22 to move upwardly. Similarly, when the piston unit 22 reaches its uppermost position, the porting of the pressure fluid is reversed to thereby cause a downward movement of the piston unit. This porting of the pressure fluid to and from the pumping chambers so as to cause a driving of the piston unit is controlled by the cycling valve assembly 101, which valve assembly operates as explained hereinafter.

Assuming that the cycling valve assembly 101 is in a centered position substantially as illustrated in FIG. 5, and that the piston unit 22 is in or adjacent its lowermost position, then the high pressure fluid is supplied through port 111 and through port 117 into annular passage 118 which extends between the valves 103 and 104. The high pressure fluid is thus supplied to the upper and lower shuttle chambers 121 and 119, respectively. If the toggle valve 104 is positioned so that the flow area created by the port 146 between the chambers 119 and 142 is less than the flow area created by the port 147 between the chambers 142 and 148, then the pressure of the fluid in the chamber 142 (and also in chamber 143) will thus be substantially at the same pressure as the low pressure accumulator 17 which is connected to the port 148. Accordingly, the high pressure fluid which exists within the shuttle chamber 119 will act on the enlarged end face of the cylindrical portion 141 and cause the toggle valve 104 to be shifted downwardly relative to the shuttle valve 103. The initial downward movement of the toggle valve 104 causes the port 146 to be closed to thereby isolate the chamber 119 from the chamber 142. At the same time, the other port 147 is fully opened to provide open communication between the chamber 142 via the port 148 and the low pressure port 109, so that the low pressure fluid is thus present within the control chamber 143. The high pressure fluid within the shuttle chambers 119 and 121 acts against the lower end face of the chambers 119 and 121 so that the shuttle valve 103 is then also moved downwardly into its lowermost position. This downward movement of the shuttle valve 103 is less than the width of the port 111, so that the port 111 continuously remains in communication with the annular passage 118 whereby high pressure fluid is continuously supplied to the upper and lower shuttle chambers 121 and 119, respectively. This downward movement of the shuttle valve 103 is, however, sufficient to provide communication between the port 111 and the port 106 so that the high pressure fluid flows into the upper pumping chamber 36 to thereby drive the piston unit 22 upwardly. At the same time, this positioning of the shuttle valve 103 places the lower pumping chamber 37 in communication with the low pressure port 109 via the intermediate port 107.

The shuttle valve 103 and toggle valve 104 will remain in the above-described lower position during the upward movement of the piston unit 22. When the piston unit 22 approaches its uppermost position, the lower power piston 24 contacts the lower toggle pin 136 and causes an upward displacement thereof, thereby compressing the lower toggle spring 137. When the resistant upward spring force is sufficient to overcome the downward hydraulic force on toggle valve 104, toggle valve 104 shifts upwardly relative to the shuttle valve 103. As the toggle valve shifts upwardly, the flow area provided by the port 146 between the chambers 119 and 142 becomes greater than the flow area provided by the port 147 between the chamber 142 and passage 148. When this condition occurs, the flow through port 146 is greater than the flow through port 147, whereby port 147 acts as a restrictor so that the high pressure fluid flows from chamber 119 into the lower chamber 142–143 causing a pressure build-up therein. This pressure build-up, acting on toggle valve 104 causes additional force which more than compensates for the decrease in spring force due to expansion of lower toggle spring 137 and compression of upper toggle spring 127. The toggle valve 104 is thus suddenly shifted upwardly a maximum amount into its upper position, which upward shifting totally closes off the port 147 and fully opens the port 146. The consequent buildup of the high pressure fluid within the lower chambers 142–143 thus creates an unbalanced upwardly directed pressure force on the shuttle valve 103, which shuttle valve is then also shifted upwardly into its uppermost position.

When the shuttle valve reaches its upper position, the land 113 isolates the high pressure port 111 from the upper pumping chamber 36, whereas the land 112 has been moved upwardly so as to provide communication between the upper pumping chamber 36 and the low-pressure port 108. At the same time, the land 114 has been displaced upwardly from the position illustrated in FIG. 5 so that high pressure fluid flows from port 111 through port 107 into the lower pumping chamber 37. Due to the flow of high pressure fluid into the lower pumping chamber 37, the upward movement of the piston unit 22 is terminated and the piston unit 22 is now driven downwardly.

When the piston unit 22 approaches its lowermost position, the upper piston 23 contacts the upper toggle pin 126 and causes downward displacement thereof, which in turn causes compression of the toggle spring 127. This again upsets the balance of forces on the toggle valve 104 and causes same to move downwardly, whereupon the port 146 is at least partially closed and the port 147 is at least partially opened to thereby permit the pressure fluid within the chambers 142–143 to discharge into the low pressure port 148. This thus upsets the pressure balance on the toggle valve 104 so that an unbalanced downward pressure force exists on the toggle valve which then shifts the toggle valve downwardly a further extent so as to completely close off the port 146 and completely open the port 147, thereby resulting in a substantial pressure differential between the fluids in the chamber 119 and the chambers 142–143. This unbalance in the pressure fluid within these chambers then causes the shuttle valve to be shifted downwardly into its lowermost position, in which position the porting to the pumping chambers is again reversed so as to permit the stopping of the downward movement of the piston unit 22, and the initiation of the upward movement thereof. In this manner, the continuous cycling of the piston unit, as caused by the pressure fluid, is continued until the speed of the piston unit is sufficient to permit self-sustained operation due to combustion within the combustion chambers.

Once the piston means 22 has been brought up to speed and the engine-pump unit started, the cycling valve assembly 101 is then deactivated by maintaining the shuttle valve 103 in its central or neutral position. This is accomplished by use of the upper and lower centering pistons 123 and 132, respectively. To center and deactivate the shuttle valve 103, the valve 158 is moved into a position whereby the passage 153 and 156 both communicate with the high pressure accumulator 18. The high pressure fluid acting against the lower centering piston 132 causes same to be moved upwardly until the centering piston contacts the stop 164. If the shuttle valve 103 is below its centering position, the upward movement of the centering piston 132 causes it to contact the shuttle valve and move it into its central position. The high pressure fluid supplied to the chamber 154 behind the upper centering piston 123 causes it to move downwardly and, if the shuttle valve is above its central position, the upper centering piston contacts the shuttle valve and moves it downwardly until it abuts the lower centering piston. The pressure area on the upper centering piston is smaller than the pressure area on the lower centering piston, so that the upper centering piston will move downwardly until it contacts the shuttle valve 103, and until the lower end of the shuttle valve contacts the lower centering piston 132, which piston is maintained in engagement with the stop 164. The shuttle valve 103 is thus confined and maintained in its central position. In this central position, the shuttle valve isolates the ports 108, 109 and 111 from the port 106 and 107.

When the centering pistons are moved inwardly to maintain the shuttle valve in its center position, the centering pistons also contact and move the toggle pins 126 and 136 inwardly so that the power pistons are no longer able to contact the toggle pins. This prevents extensive wear on the pins when they are not being used, as during normal operation of the engine-pump unit.

When the engine is to be restarted after being stopped, then the valve 158 is shifted back into a position wherein the passages 153 and 156 communicate with the low pressure reservoir 17, whereupon the toggle spring 127 and 137 respectively move the upper and lower centering pistons outwardly against the respective end caps, whereupon the shiftable movement of the shuttle and toggle valves is then permitted to occur in the manner described above.

Fuel Injection System

Figure 6:
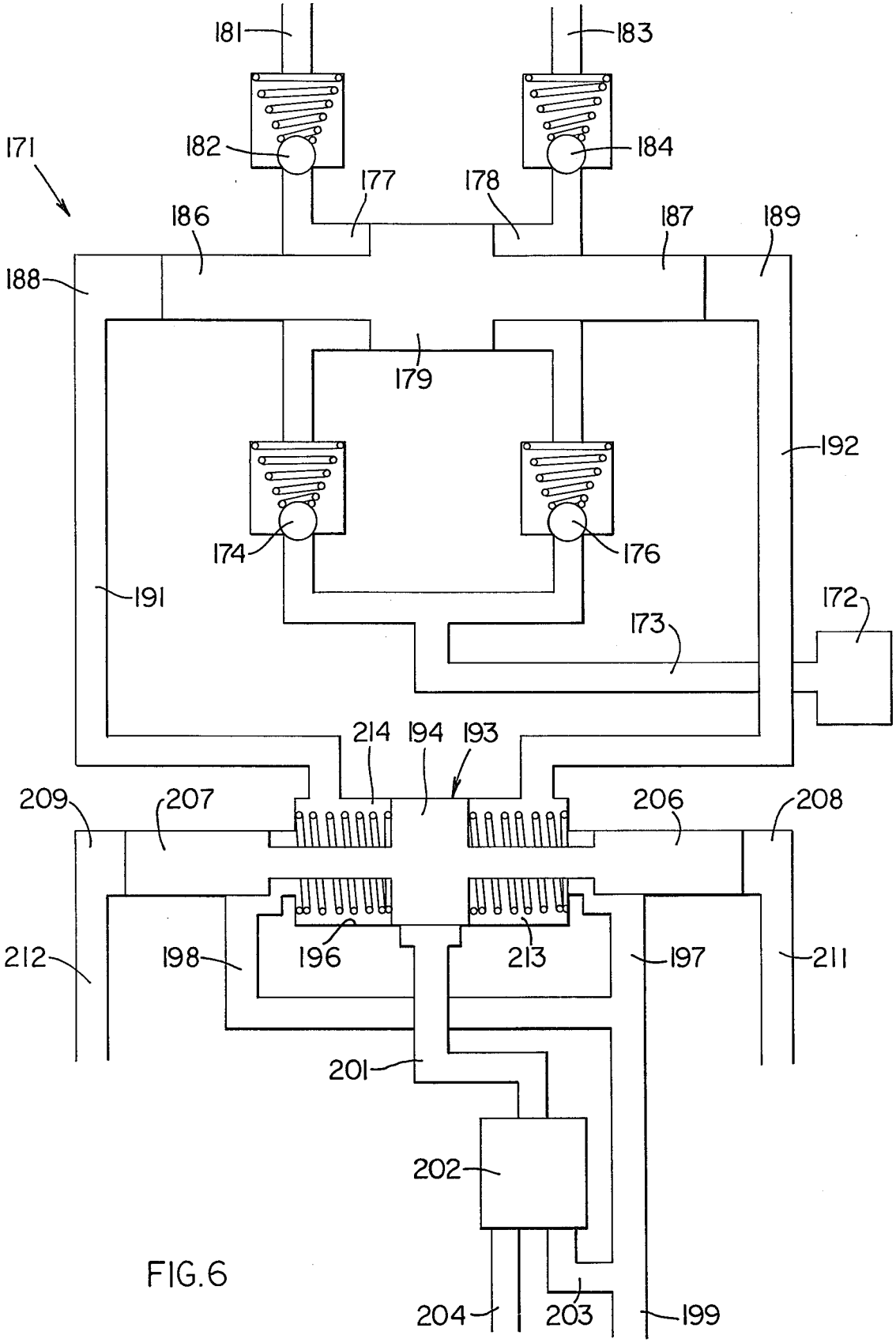
FIG. 6 diagrammatically illustrates a fuel injection system for use with the engine-pump unit.

FIG. 6 illustrates a fuel injection system 171 suitable for use with the engine-pump unit of the present invention, particularly for supplying fuel to the fuel injectors 84 and 86 as illustrated in FIG. 3.

The fuel injection system 171 is supplied with fuel from a storage tank 172 through a passage 173 into a pair of branch passages which contain therein one-way check valves 174 and 176. These branch passages in turn communicate with fuel metering chambers 177 and 178 which are located on opposite sides of a slidable fuel metering piston 179. Leftward movement of the piston 179 causes a metered quantity of fuel to be supplied from chamber 177 through passage 181, and through the associated one-way check valve 182, for supply to the upper fuel-injector 84. In a similar manner, rightward movement of piston 179 causes fuel to be supplied from chamber 178 through passage 183, and the associated one-way check valve 184, to the lower fuel injector 86.

The piston 179 has actuating portions 186 and 187 projecting outwardly from opposite ends thereof and slidably disposed within chambers 188 and 189, respectively. These latter-mentioned chambers in turn respectively communicate with passages 191 and 192, with flow through these passages being controlled by a piston assembly 193.

The piston assembly 193 contains therein a piston member 194 slidably disposed within a bore 196. Passages 197 and 198 communicate with opposite ends of the bore 196, and these passages in turn communicate with a passage 199 which connects to the low pressure accumulator 17.

The piston member 194, when in its central position as illustrated in FIG. 6, closes off a passage 201, which passage is adapted for connection to a further passage 204 which communicates with the high pressure accumulator 18. A valve 202 is disposed for providing selected communication between the passages 201 and 204. The piston member 194 has piston portions 206 and 207 extending outwardly from opposite ends thereof and slidably disposed within chambers 208 and 209, respectively. The chamber 208 communicates with the upper combustion chamber 28 by means of a passage 211, and in a similar manner the chamber 209 communicates with the lower combustion chamber 29 by means of an intermediate passage 212.

Operation of Fuel Injection System

Assuming that the piston member 194 is initially in a right-ward position and that the fuel metering piston 179 is also in a right-ward position, so that the high pressure fluid is supplied to the chamber 214 and thence through the passage 191 to the chamber 188. The high pressure fluid in the chamber 214 thus maintains the piston 194 in a rightward position and likewise the high pressure fluid in chamber 188 maintains the fuel metering piston 179 in its rightward position. With the piston member 194 in its rightward position, the piston portion 207 seals off the passage 198 from the chamber 214. As the piston unit 22 approaches its top dead center position, the resulting increase in gas pressure within the combustion chamber 28 is communicated to the chamber 208 via the passage 211, and at the same time the decrease in pressure in the lower combustion chamber 29 is communicated to the chamber 209 via the passage 212. The unbalanced pressure force which exists on the piston member 194 thus causes the piston member 194 to be shifted leftwardly and, after passing over the passage 201, the high pressure fluid is supplied to the chamber 213 so that the pressure fluid maintains the piston member 194 in its leftward position. The high pressure fluid then flows through chamber 213 and through passage 192 into the chamber 189, whereupon the fuel metering piston 179 is shifted leftwardly so that the fuel within the chamber 177 is then forced through the passage 181 and supplied through the upper fuel injector 84. At the same time, the chamber 214 and passage 198 communicate with the low pressure passage 199.

In a similar manner, when the piston unit approaches its bottom dead center position, the pressure increase within the lower combustion chamber is communicated via passage 212 to chamber 209, so that piston 194 is then shifted into its right-ward position. High pressure fluid flowing through chamber 214 and passage 191 then cause the fuel metering system 179 to be shifted rightwardly, whereupon a quantity of fuel within chamber 178 flows through passage 183 and is supplied to the lower fuel injector 86.

When fuel injection is to be terminated, the valve 202, which may comprise a conventional 3-way solenoid valve, is activated so as to connect the passage 201 to the low pressure passage 203, which effectively closes off the high pressure passage 204.

Control System

Figure 7:
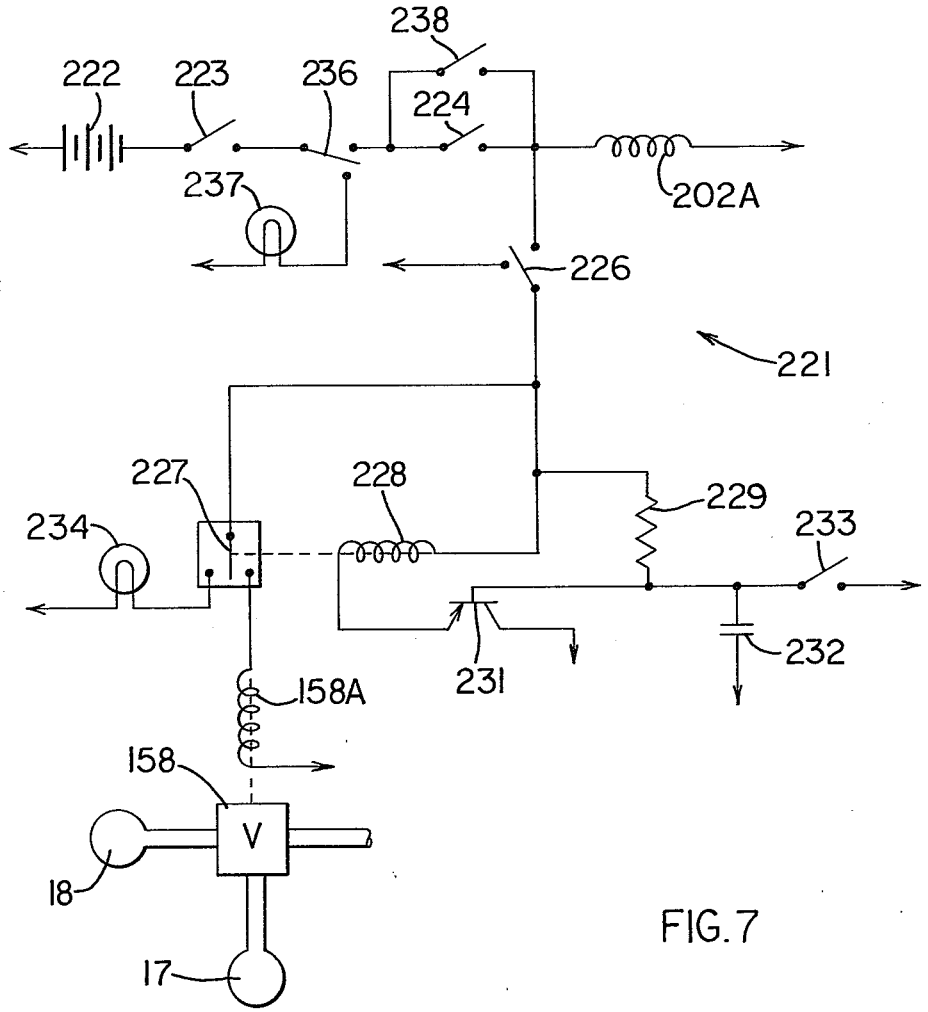
FIG. 7 diagrammatically illustrates a control circuit for the propulsion system.

FIG. 7 illustrates a basic control system 221 for controlling the starting and restarting of the engine-pump unit. The control system is interconnected to the vehicle battery 222, with the system being energized by the vehicle ignition switch 223. An accumulator switch 224 is connected to the ignition switch and is normally maintained in an open position, which accumulator switch 224 will close when the high pressure accumulator needs to be recharged. Ignition switch is also connected to a coil 202A associated with the valve 202 (FIG. 6) for activating the fuel-injection system 171 by shifting the valve 202 so that the high-pressure passage 204 is connected to the supply passage 201.

The voltage across the ignition switch 223 is also supplied across an exhaust switch 226, which switch is closed when the engine pump is not running, as explained hereinafter. The voltage is then supplied through a relay switch 227 for causing energization of a solenoid coil 158A associated with the valve 158, which valve 158 when energized releases the centering pistons so that the cycling valve assembly 101 can be activated. The relay 227 is activated by the relay coil 228, which coil is also connected to the ignition switch and has the same voltage supplied thereacross. The relay coil 228 is controlled by a timer circuit which includes a timing resistor 229, a timing transistor 231, and a timing capacitor 232. When voltage is first applied to the relay coil 228, the base of the transistor 231 is at ground and the transistor will allow current to flow to the ground from the coil. The coil 228 is thus energized so that switch 227 will be closed to energize the valve coil 158 and the startup sequence will occur. Current will also flow through the timing resistor 229 so as to charge the timing capacitor 232, thereby causing the voltage applied to the base of the transistor 231 to rise. This thus continuously lowers the voltage drop across the relay coil 228 until the current flow is too low to keep the relay coil in an energizer condition. When this happens, the switch 227 returns to a position wherein it is normally engaged with the light 234 so as to cause energization of same and thereby indicate to the driver a failure of the engine to start. This latter condition will, however, occur only if the engine fails to start during the time delay created by the timing circuit. Normally the engine will start before the timing out of this timed delay, in which case the exhaust switch 226 will be opened and thereby terminate the voltage which is supplied to the timing circuit.

If the engine fails to start, and the driver wishes to make another attempt to start the engine, then he momentarily closes the reset switch 233 so as to discharge the capacitor 232 whereupon the complete timing cycle can then again be initiated by closing of the ignition switch 223.

In the illustrated control system, the ignition switch is also connected in series with a normally closed pressure switch 236, which switch is opened when an overpressure condition exists within the high pressure accumulator. This overpressure condition is also indicated by means of a light 237 which is energized when the pressure switch 236 is activated. An accelerator switch 238 is also connected in parallel with the accumulator switch 224, which accelerator switch closes when the vehicle driver substantially fully depresses the accelerator pedal, thereby permitting bypassing of the accumulator switch 224 so that the engine will build up additional pressure in the accumulator even after the accumulator switch opens. This build-up of pressure within the accumulator is, however, still controlled by the overpressure switch 236.

Regarding the exhaust switch 226, same may comprise a microswitch actuated by a paddle disposed in the exhaust pipe, which paddle is displaced by the velocity of the exhaust gasses through the pipe so as to cause opening of the switch 226 when the engine is operating.

Scavenge Valve Actuation

Figure 8:
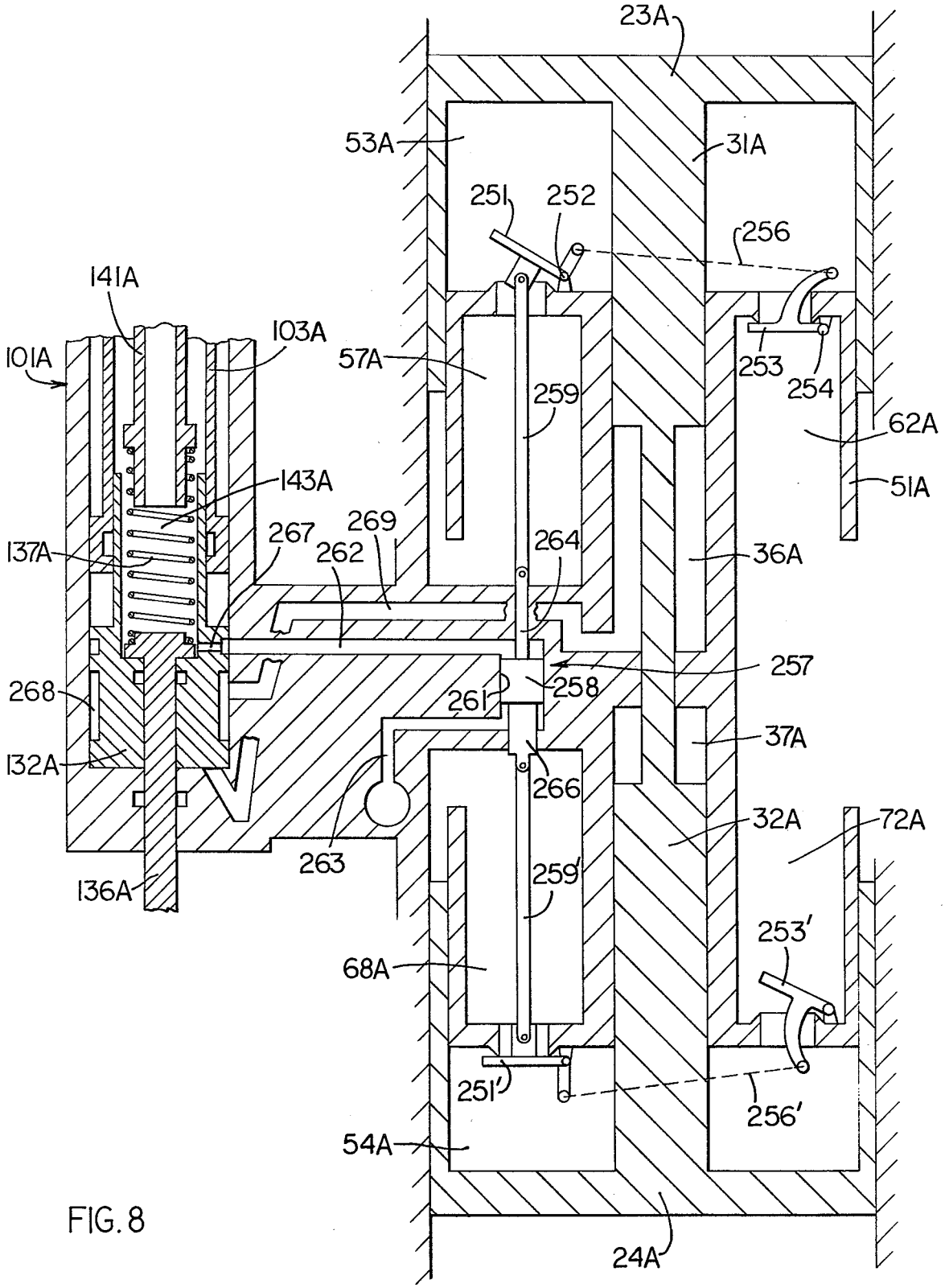
FIG. 8 is a fragmentary cross-sectional view of the scavenge valve system for controlling the flow of gases to the combustion chamber.

Referring to FIG. 8, same illustrates therein a scavenge valve actuation system which can be utilized in place of the one-way check valves of FIG. 3 for controlling the flow of air to the combustion chambers. Since the system of FIG. 8 utilizes much of the same structure previously described, the corresponding parts have been designated by the same reference numerals but with an "A" added thereto.

The flow of air to and from the intermediate air chamber 53A as formed within the upper piston 23A is controlled by plate valves 251 and 253 which are respectively hinged at 252 and 254 to the guide member 51A. The valves 251 and 253 are pivotally connected to the opposite ends of a rod 256 which extends therebetween so that the two plate valves are actuated simultaneously. A similar valve arrangement is also associated with the lower power piston 24A for controlling the flow of air into and out of the intermediate chamber 54A. The elements associated with the lower power piston have been designated by the same reference numerals but with a prime (') added thereto.

The movement of the plate valve 251, 253, 251' and 253' is controlled by a valve actuator 257 which includes an actuator piston 258 interconnected to the plate valves 251 and 251' by connecting rods 259 and 259', respectively. The actuator piston 258 is slidably disposed within a chamber 261 formed in the housing. The upper end of chamber 261 communicates via a passage 262 with the lower end of the cycling valve assembly 101A. The lower end of the chamber 261 communicates via a passage 263 with the high pressure accumulator 18.

While FIG. 8, illustrates only a portion of the cycling valve assembly 101A, nevertheless this assembly is identical to the cycling valve assembly illustrated in FIG. 5 except for the structure of the lower centering piston 132A. For use with the scavenge valve system of FIG. 8, the lower centering piston 132A is provided with a port 267 extending therethrough for communication with the shuttle control chamber 143A. The port 267 at its outer end communicates with the passage 262 when the centering piston 132A is in its engine starting position, that is, its lowermost position. When so positioned, the pressure within the shuttle chamber 143A communicates via passage 262 to the upper end of the chamber 261.

The lower centering piston 132A is also provided with an annular groove 268 formed in the periphery thereof, which groove 268 is in continuous communication with a passage 269, which passage in turn communicates with the pumping chamber 36A associated with the upper power piston. The groove 268 is of sufficient length to permit communication between the passages 262 and 269 when the centering piston 132A is in its uppermost position.

The actuator piston 258 has rod portions 264 and 266 extending outwardly from the opposite ends thereof. The rod portion 264 is of substantially smaller diameter than the lower rod portion 266, whereby the pressure area of the piston 258 which is exposed to the pressure fluid is in the upper end of the chamber 261 is thus substantially greater than the pressure area of the piston as exposed to the lower end of the chamber.

Operation of Scavenge Valve System

During steady-state operation of the engine-pump unit, the cycling valve assembly 101A remains in a centered or inactive position and is held there by the upper and lower centering pistons, which centering pistons are spaced inwardly as previously described. Thus, when in this inactive or centered position, the lower centering piston 132A is spaced upwardly from the position illustrated in FIG. 8 so that the passage 262 is in continuous communication with passage 269 by means of the annular groove 268. Thus, the pressure of the fluid within the pumping chamber 36A is continuously communicated with the upper end of the chamber 261. Thus, when the power pistons 23A and 24A are moving upwardly, low pressure exists in chamber 36A so that the high pressure within passage 263 moves the piston 258 upwardly so that valves 251 and 253' are opened and valves 251' and 253 are closed. Air thus flows into chamber 53A as the piston 23A moves upwardly, and simultaneously the pressurized air in chamber 54A flows past the valve 253' into passage 72A when the piston 24A moves upwardly.

When the pistons reach their top dead center position and begin to move downwardly, the oressure in chamber 36A is rapidly increased so that high pressure fluid is then supplied to the upper end of chamber 261. Since the upper pressure area on piston 258 is larger than the lower pressure area, this causes the piston 258 to be moved downwardly so that valves 251 and 253' are closed and simultaneously valves 251' and 253 are opened. This thus permits air to flow into the chamber 54A and enables the pressurized air in chamber 53A to flow out into the passage 62A.

During startup of the engine-pump unit, the cycling valve assembly is activated and the lower centering piston 132A is in the lowered position illustrated in FIG. 8. Thus, the pressure fluid within the shuttle control chamber 143A is thus supplied through passage 262 into the upper end of the piston chamber 261. When the power pistons are being moved upwardly, the cycling valve assembly is in its lowermost position and low pressure fluid is present in the shuttle control chamber 143A. Since this low pressure fluid is also supplied to the upper end of the piston 258, the high pressure fluid which acts against the lower end of the piston 258 moves the piston upwardly so that plate valves 251 and 253' are opened and the plate valves 251' and 253 are simultaneously closed. When the power pistons reach their upper dead center position during startup of the engine, the cycling valve is shifted upwardly whereupon high pressure fluid is supplied to the shuttle chamber 143A, as previously described, whereupon the high pressure fluid is supplied to the upper end of the actuator piston 258 so that same is then shifted downwardly.

This thus causes closing of the plate valves 251 and 253' and opening of the plate valves 251' and 253 when the power pistons move downwardly.

In this manner, proper sequencing of the opening and closing of the plate valves associated with the power pistons is insured both during start-up and during normal engine operation.

Modified Fuel Injection System

Figure 9:
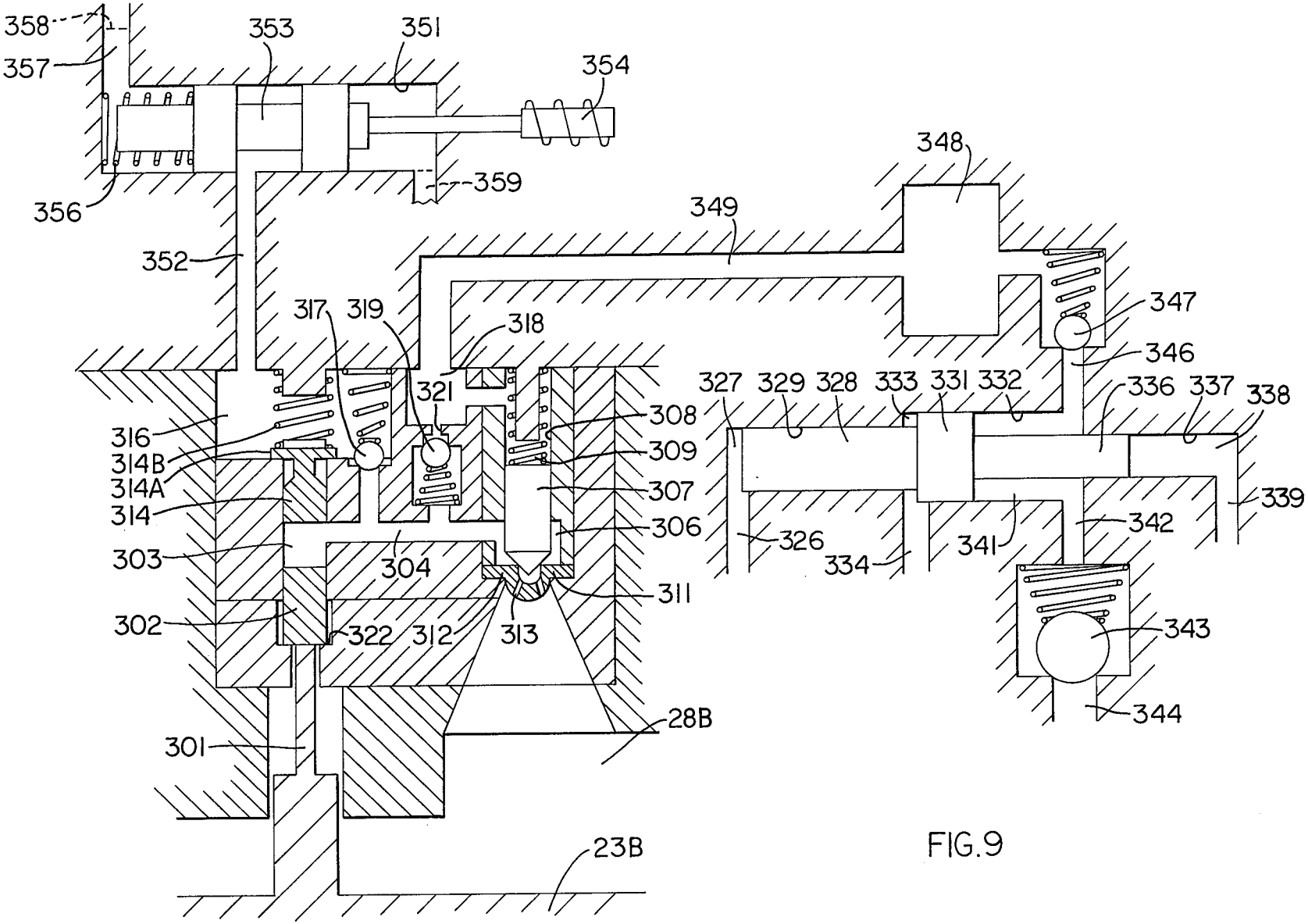
FIG. 9 is a fragmentary sectional view of a modified fuel injection system.

FIG. 9 illustrates a modified fuel-injection system which can be used for controlling the flow of fuel to the upper and lower combustion chambers. The injection system of FIG. 9 can be used in place of the injector system of FIG. 6, as previously described.

In the system illustrated in FIG. 9, the power piston 23B of the engine-pump unit has an upward extension 301 which, during the last part of the upward compression stroke of the piston, moves an injection piston 302 upwardly so as to compress the fuel located in the chamber 303. This pressure increase on the fuel is communicated through the passage 304 to the fuel located in an annulus 306 which surrounds the poppet valve 307. This poppet valve 307 is normally urged downwardly by a spring 309 which is located in the chamber 308, which chamber 308 is also filled with fuel, whereby the lower conical end of the valve 307 is maintained in engagement with a valve seat 311 formed on the nozzle member 312. However, the increase in pressure in the fuel within the annulus 306 causes the poppet valve 307 to move upwardly and out of engagement with the seat 311, thereby allowing fuel to flow through the orifices 313 into the combustion chamber 28B. Further injection of fuel into the combustion chamber is accomplished by continued upward motion of injector piston 302 until it contacts the plug 314. This plug is slidably arranged in the chamber 303 but prevents communication between chambers 303 and chamber 316. When injector piston 302 contacts the plug 314, the injection of fuel into the combustion chamber is effectively terminated since further pressurization of the fuel in annulus 306 is not possible. The lower end of piston 314 is preferably disposed above the upper wall of passage 304 to create a fluid cushion for stopping the upward movement of piston 302.

During injection, the pressure in chamber 303 can communicate with chamber 316 by means of the intermediate one-way check valve 317. The pressure in chamber 316 is thus essentially that of the highest pressure that existed in chamber 303 during the previous injection cycles. This prevents plug 314 from moving until it is contacted by piston 302. This eliminates the need for a heavily loaded spring to urge plug 314 downward. Lightly loaded spring 314B is used to insure that plug 314 is downward when the first injection cycles occur during start up. Chamber 316 is of sufficient volume that its reduction in volume due to the upward motion of plug 314 does not cause an undue amount of increase in pressure in chamber 316.

When power piston 23B starts to move downwardly, the plug 314 returns to its illustrated position as determined by stop 314A. The injector piston 302 also tends to return downwardly but is momentarily stopped due to the excess pressure in the combustion chamber 28B compared with that of the pressure in the chamber 303. At this time, the pressurized fuel in chamber 318 flows through the check valve 319 so as to refill the chamber 303 and thereby move the injector piston 302 downwardly. This filling process continues during the rest of the downward stroke and the subsequent upward stroke of the power piston 28B until the power piston projection 301 again contacts the injector piston 302. The distance the piston 302 travels downwardly is determined by the quantity of fuel that flows through the check valve 319 into the chamber 303. This quantity is determined by the time interval which elapses after the last injection.

This effect tends to create a governing action so that when the engine speeds up, the quantity of fuel injected reduces and vice versa. The supply pressure of the fuel in the chamber 318 is a function of the pumping pressure in the engine pump, which is a measure of the load on the engine, as described hereinafter. The flow rate of the fuel in turn is proportional to the square root of the pressure drop across the orifice 321. This also results in a governing action, increasing the quantity of fuel delivered by injection when the load on the engine pump increases, and vice versa.

Injector piston 302 is able to move downwardly until it contacts a stop 322. At this point of contact, the resulting volume of fuel which would be injected represents the maximum amount that should be injected based upon the displacement of the end of the power piston. During usual operation, the amount of fuel being injected is not a maximum so that the injector piston does not contact this stop. During the filling process, there is thus little or no pressure drop across the injector piston. This minimizes or eliminates fuel leakage therepast.

During startup of the engine pump unit, the first starting cycle of the power piston does not create a large enough excursion of the power piston to axially move the injector piston, but it does build up the fuel supply pressure within the chamber 318. This also brings the fuel pressure in chamber 303 and 316 to the same level. The injector piston 302 is down against the stop 322 at this time period. On the next cycle of the power piston, the ejector piston 302 is moved upwardly. However, instead of a majority of the fuel being injected through the nozzle 311, much of this fuel flows through check valve 317 into chamber 16. This situation occurs for several cycles, tending to build up the quantity of fuel injected through orifices 313 slowly so as to provide a smooth transition to a self-sustaining operation of the engine.

The generation of fuel-supply pressure to the chamber 318 is also illustrated in FIG. 9. A port or passage 326 is connected to one of the engine pump chambers 36 or 37, so that the pressure in passage 326 therefore cyclically varies from that of the high and low pressure accumulators. The passage 326 terminates in a chamber 327 wherein the pressure fluid acts on one end of a slidable piston 328. This piston is slidably arranged in a bore 329 and has the other end thereof disposed in contact with a larger diameter piston 331, which in turn is slidably disposed in a larger bore 332. A chamber 333 is formed adjacent the leftward end of piston 331 and is connected by a passage 334 to the low pressure accumulator 17. The pressure in chamber 333 is thus always low.

A further piston 336 contacts the other end of piston 331. Piston 336 is slidably disposed in a bore 337 and is acted upon by pressure within the chamber 338, which chamber is connected by a passage 339 to the high pressure accumulator 18.

The three pistons 328, 331 and 336 will cycle back and forth as a unit, the pistons being urged to the left when the pressure in chamber 327 is low, and being urged to the right when the pressure in chamber 327 is high. When leftward motion of the pistons takes place, the increase in volume of chamber 341 causes fuel to flow into it from passage 342, this flow being allowed by check valve 343 as supplied by passage 344, which passage 344 is preferably connected to a fuel priming pump but may lead directly to a fuel storage tank.

When the pistons are urged to the right, fuel flows from chamber 341 through passage 346 as allowed by the check valve 347 into the chamber 348. This intermediate fuel storage chamber 348 in turn communicates with the fuel chamber 318 by means of the intermediate passage 349.

Thus, a pumping action is created to supply fuel at high pressure to the injection device. Further, the maximum volume delivered per movement cycle of the pistons 328, 331 and 336 is large compared to that desired to be injected per engine cycle. This excess volume of fuel is used to charge the chambers 316 and 348. Since chamber 348 is comparatively large and requires one or more piston cycles to accomplish the rise to injection pressure, this allows chamber 348 to supply the required fuel for several fuel injection cycles simply by expansion of the compressed fuel contained in the compressed chamber. This facilitates the startup sequence of the engine-pump unit.

For stopping the engine-pump unit, the fuel pressure within the chamber 316 is released. For this purpose, the chamber 316 communicates with a bore 351 by means of an intermediate passage 352. The bore 351 has a spool valve 353 slidably disposed therein for normally closing off the passage 352 when positioned as illustrated in FIG. 9. The spool valve 353 is normally urged into the illustrated closed position by means of an electrical solenoid 354. However, when shutoff of the engine is desired, the solenoid 354 is deenergized whereupon spring 356 urges the spool valve 353 rightwardly so as to uncover the passage 352, which passage then communicates with a further passage 357, which passage 357 connects to the fuel tank. An orifice 358 can be associated with passage 357, if desired, so as to cause a pressure build-up in the leftward end of bore 351 so as to cause the spool valve to be moved rightwardly into a fully open position.

If desired, the solenoid 354 can be eliminated, and instead a further passage 359 can be provided for communication with the rightward end of the bore 351. This passage 359 would in turn communicate with the passage 344 which contains therein the pressurized fuel. Thus, when the engine is on, the pressurized fuel is supplied against the rightward end of the spool and causes same to move into a closed position, wherein passage 352 is isolated from the passage 357.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A free-piston engine-pump unit, comprising in combination:

housing means defining therein first and second coaxially aligned and axially spaced bore means;

first and second piston means slidably disposed in said first and second bore means respectively, said first and second piston means being fixedly interconnected for simultaneous reciprocating movement;

each said piston means including a power piston coacting with the respective bore means to define a combustion chamber adjacent one end thereof, each said piston means also including a pumping piston fixed relative to the power piston and coacting with the respective bore means to define a pumping chamber adjacent the other end thereof;

supply conduit means connected to said pumping chambers for supplying a low pressure working fluid thereto;

discharge conduit means connected to said pumping chambers for permitting the pressurized working fluid to be discharged therefrom;

means associated with each of said combustion chambers for supplying combustible fuel thereto;

discharge passage means for discharging the exhaust gases from the combustion chambers;

inlet passage means for supplying air to the combustion chambers, said inlet passage means including an intermediate air supply chamber associated with each of said power pistons and defined between the respective power piston and a portion of said housing means, each said intermediate chamber being disposed on the opposite axial side of the respective power piston from the respective combustion chamber;

said inlet passage means also including a first passage for supplying air into each said intermediate chamber and a second passage for discharge of air from each respective intermediate chamber for supply to said combustion chambers;

valve means associated with said inlet passage means for permitting air to flow through said first passage into the respective intermediate chamber during the compression stroke of the respective power piston and for permitting air to flow from said intermediate chamber into said second passage during the power stroke of the respective power piston;

said valve means including a first valve associated with each said intermediate chamber for permitting air flow through said first passage into the respective intermediate chamber solely when the respective power piston is moving on its compression stroke, and said valve means including a second valve associated with each said intermediate chamber for permitting discharge of air from the respective intermediate chamber into the second passage solely when the respective power piston is moving on its power stroke; and link means mechanically interconnecting said first valves together for causing simultaneous actuation thereof and for causing closing of one of said first valves during opening of the other of said first valves, and vice versa.

2. A combination according to claim 1, including linkage means mechanically interconnected between the first and second valves as associated with each said intermediate chamber for causing simultaneous actuation thereof and for causing closing of the respective second valve during opening of the respective first valve, and vice versa.

3. A combination according to claim 1, including control means responsive to the working fluid as supplied to and discharged from said pumping chambers for causing actuation of said link means.

4. A combination according to claim 1, wherein said housing means includes a charging chamber for storing therein the pressurized air which is discharged from said intermediate chambers, said charging chamber communicating with both of the combustion chambers and also communicating with the second passage as associated with each of said intermediate chambers.

5. A combination according to claim 1, wherein said power piston is of a cup-shaped configuration and includes an annular skirt portion which is slidably supported on and surrounds a portion of said housing means so as to define said intermediate air supply chamber therebetween and within said power piston, said portion of the housing means including a transverse wall which is disposed in and extends across the interior of the power piston, whereby said intermediate chamber increases in volume during the compression stroke of the power piston to induce air into said intermediate chamber, and whereby the intermediate chamber decreases in volume during the power stroke of the power piston to pressurize and discharge the air from said intermediate chamber.

6. A free-piston engine-pump unit, comprising in combination:

housing means defining therein first and second coaxially aligned and axially spaced bore means;

first and second piston means slidably disposed in said first and second bore means respectively, said first and second piston means being fixedly interconnected for simultaneous reciprocating movement;

each said piston means including a power piston coacting with the respective bore means to define a combustion chamber adjacent one end thereof, each said piston means also including a pumping piston fixed relative to the power piston and coacting with the respective bore means to define a pumping chamber adjacent the other end thereof;

supply conduit means connected to said pumping chambers for supplying a low pressure working fluid thereto;

discharge conduit means connected to said pumping chambers for permitting the pressurized working fluid to be discharged therefrom;

means associated with each of said combustion chambers for supplying combustible fuel thereto;

discharge passage means for discharging the exhaust gases from the combustion chambers;

means defining a storage chamber within said housing means for storing therein pressurized air, and a pair of transfer passages providing communication between said storage chamber and said combustion chambers, each of said transfer passages providing communication between said storage chamber and a respective one of said combustion chambers, each said transfer passage communicating with the bore means defining the respective combustion chamber at a location whereby the discharge end of said transfer passage is alternately opened and closed responsive to the reciprocation of the respective power piston; and air pressurizing means associated with each of said power pistons for pressurizing air and then supplying same to said storage chamber;

said pressurizing means as associated with each said power piston including an intermediate air supply chamber defined between the housing means and the respective piston means whereby air within the intermediate chamber is pressurized by the piston means during the power stroke thereof, an inlet passage communicating with said intermediate chamber to permit air to be supplied thereto during the compression stroke of the piston means, and a discharge passage providing communication between the intermediate chamber and the storage chamber to permit the pressurized air to flow from the intermediate chamber into said storage chamber.

7. A combination according to claim 6, wherein the storage chamber includes portions which substantially surround the combustion chambers but are isolated therefrom by said housing means so that the pressurized air in said storage chamber is preheated by the heat which escapes from the combustion chambers.

8. A combination according to claim 6, including movable one-way valve means associated with each of said air-pressurizing means for controlling the flow of air therethrough into said storage chamber.

9. A combination according to claim 6, including movable one-way valve means associated with each of said inlet passages for permitting flow therethrough into the respective intermediate chamber.

10. A combination according to claim 6, including movable one-way valve means associated with each of said discharge passages for permitting flow therethrough from the respective intermediate chamber into said storage chamber.

11. A free-piston engine-pump unit, comprising in combination:

housing means defining therein first and second coaxially aligned and axially spaced bore means;

first and second piston means slidably disposed in said first and second bore means respectively, said first and second piston means being fixedly interconnected for simultaneous reciprocating movement;

each said piston means including a power piston coacting with the respective bore means to define a combustion chamber adjacent one end thereof, each said piston means also including a pumping piston fixed relative to the power piston and coacting with the respective bore means to define a pumping chamber adjacent the other end thereof;

supply conduit means connecting to said pumping chambers for supplying a working fluid thereto;

discharge conduit means connected to said pumping chambers for permitting the working fluid to be discharged therefrom;

inlet and discharge passage means connected to the combustion chambers for respectively supplying air thereto and discharging exhaust gases therefrom;

control means for supplying pressurized working fluid into said pumping chambers to drivingly reciprocate said first and second piston means during start-up of the engine, said control means including first and second control conduits communicating with the pumping chambers of the first and second bore means respectively;

said control means also including shiftable control valve means associated with said first and second control conduits for alternately and sequentially permitting the flow of high pressure working fluid to the pumping chambers to drivingly reciprocate the piston means back-and-forth until the engine is started, said control valve means being movable between a first end position wherein high pressure working fluid is supplied to one of the pumping chambers and a second end position wherein high pressure pumping fluid is supplied to the other pumping chamber;

said control valve means including a slidable valve member which is linearly reciprocal between said first and second end positions, and said control valve means also including means cooperating with said valve member for positively urging same into one end position after the valve member has been moved a small distance away from the opposite end position, and vice versa; and mechanical means cooperating directly between said piston means and said control valve means for initiating automatic shifting of said control valve means between said first and second end positions in response to reciprocating movement of said piston means during start-up of the engine.

12. A combination according to claim 11, wherein said mechanical means includes first and second movable elements disposed for movement by the respective first and second piston means, said first and second movable elements cooperating with said shiftable control valve means for initiating shifting thereof between said first and second end positions.

13. A combination according to claim 11, wherein said mechanical means includes first and second elements slidably supported on said housing means and positioned for engagement with and displacement by the respective first and second piston means as the latter approach their innermost positions, and said control valve means including a valve positioned between and slidably reciprocated back-and-forth by said first and second elements.

14. A free-piston engine-pump unit, comprising in combination:

housing means defining therein first and second coaxially aligned and axially spaced bore means;

first and second piston means slidably disposed in said first and second bore means respectively, said first and second piston means being fixedly interconnected for simultaneous reciprocating movement;

each said piston means including a power piston coacting with the respective bore means to define a combustion chamber adjacent one end thereof, each said piston means also including a pumping piston fixed relative to the power piston and coacting with the respective bore means to define a pumping chamber adjacent the other end thereof;

supply conduit means connecting to said pumping chambers for supplying a working fluid thereto;

discharge conduit means connected to said pumping chambers for permitting the working fluid to be discharged therefrom;

inlet and discharge passage means connected to the combustion chambers for respectively supplying air thereto and discharging exhaust gases therefrom;

control means for supplying pressurized working fluid into said pumping chambers to drivingly reciprocate said first and second piston means during start-up of the engine, said control means including first and second control conduits communicating with the pumping chambers of the first and second bore means respectively;

said control means also including shiftable control valve means associated with said first and second control conduits for alternately and sequentially permitting the flow of high pressure working fluid to the pumping chambers to drivingly reciprocate the piston means back-and-forth until the engine is started, said control valve means being movable between a first end position wherein high pressure working fluid is supplied to one of the pumping chambers and a second end position wherein high pressure working fluid is supplied to the other pumping chamber;

said control valve means including a slidably shiftable sleevelike shuttle valve for controlling the flow of pressure fluid through said first and second conduits, and a toggle valve slidably supported in said sleevelike shuttle valve and shiftable axially with respect thereto, said shuttle and toggle valves being slidably reciprocal between said first and second end positions;

said control valve means also including fluid chambers associated with the opposite ends of said toggle and shuttle valves, and porting means cooperating with said fluid chambers for supplying pressurized working fluid thereto to cause a pressure force to be imposed axially on the shuttle and toggle valves to assist in rapid shifting of the respective valve toward one of said end positions after it has been moved slightly away from the other end position; and mechanical means cooperating directly between said piston means and said control valve means for initiating automatic shifting of said control valve means between said first and second end positions in response to reciprocating movement of said piston means during start-up of the engine.

15. A combination according to claim 14, wherein said mechanical means includes a pair of elongated slidable toggle pins disposed adjacent the opposite ends of said toggle valve and positioned for engagement with a respective one of the power pistons when the latter approaches its innermost position, whereby movement of the respective power piston into its innermost position causes slidable displacement of one of the toggle pins which then causes the toggle valve to be slightly moved away from one of the end positions, whereupon the fluid chambers then apply a fluid shifting force to the valves to positively move same into the other end position.

16. A combination according to claim 14, including fluid-urged centering pistons cooperating with said valves for moving said valves into a centered position and for holding the valves in this centered position after the engine has started.

17. A free-piston engine-pump unit, comprising in combination:

housing means defining therein first and second coaxially aligned and axially spaced bore means;

first and second piston means slidably disposed in said first and second bore means respectively, said first and second piston means fixedly interconnected for simultaneous reciprocating movement;

each said piston means including a power piston coacting with the respective bore means to define a combustion chamber adjacent one end thereof, each said piston means also including a pumping piston fixed relative to the power piston and coacting with the respective bore means to define a pumping chamber adjacent the other end thereof;

supply conduit means connected to said pumping chambers for supplying a low-pressure working fluid thereto;

discharge conduit means connected to said pumping chambers for permitting the pressurized working fluid to be discharged therefrom;

inlet passage means for supplying air to the combustion chambers;

discharge passage means for discharging the exhaust gases from the combustion chambers; and fuel injection means associated with each of said combustion chambers for supplying combustible fuel thereto, said fuel injector means including controlling means responsive to the working fluid for controlling the injection of fuel into the combustion chambers, said controlling means including a fuel flow-control piston shiftable between first and second positions by the working fluid to control the injection of fuel into the respective combustion chamber associated with the first and second bore means when the flow-control piston is in said first and second positions, respectively.

18. A combination according to claim 17, including secondary controlling means responsive to the pressure developed in one of the combustion chambers for controlling the flow of working fluid to said fuel flow-control piston, said secondary controlling means including a secondary piston which is shiftably movable in response to the pressure developed in said one combustion chamber.

19. A free-piston engine-pump unit, comprising in combination:

housing means defining therein first and second coaxially aligned and axially spaced bore means;

first and second piston means slidably disposed in said first and second bore means respectively, said first and second piston means fixedly interconnected for simultaneous reciprocating movement;

each said piston means including a power piston coacting with the respective bore means to define a combustion chamber adjacent one end thereof, each said piston means also including a pumping piston fixed relative to the power piston and coacting with the respective bore means to define a pumping chamber adjacent the other end thereof;

supply conduit means connected to said pumping chambers for supplying a low-pressure working fluid thereto;

discharge conduit means connected to said pumping chambers for permitting the pressurized working fluid to be discharged therefrom;

inlet passage means for supplying air to the combustion chambers;

discharge passage means for discharging the exhaust gasses from the combustion chambers; and fuel injection means associated with each of said combustion chambers for supplying combustible fuel thereto, said fuel injection means as associated with each said combustion chamber including nozzle means communicating with the respective combustion chamber and a movable fuel injection piston which is movable between a first position which closes off the nozzle means and a second position which permits flow of fuel through said nozzle means into the respective combustion chamber;

said fuel injection means also including means defining a fuel supply chamber which communicates with said nozzle means for supplying fuel thereto, and a movable piston associated with said chamber for pressurizing the fuel therein; and actuating means for movably displacing said movable piston to thereby pressurize the fuel in said fuel supply chamber, said actuating means including an actuating member which cooperates directly between the respective power piston and the respective movable piston for causing movement of the movable piston to thereby pressurize the fuel in response to movement of the respective power piston during its compression stroke.

* * * * *